United States Patent [19]

Powell

[11] Patent Number: 4,763,821

[45] Date of Patent: Aug. 16, 1988

[54] SECURITY WALLET

[76] Inventor: Mark S. Powell, 5052 Mt. Etna Dr., San Diego, Calif. 92117

[21] Appl. No.: 99,636

[22] Filed: Sep. 22, 1987

Related U.S. Application Data

[63] Continuation of Ser. No. 925,748, Oct. 31, 1986, abandoned.

[51] Int. Cl.[4] ..... A45F 5/00

[52] U.S. Cl. ..... 224/267; 224/253; 224/222

[58] Field of Search ..... 224/253, 222, 267, 252, 224/219; 150/102, 134, 132

[56] References Cited

U.S. PATENT DOCUMENTS

| | | | |
|---|---|---|---|
| 214,823 | 4/1879 | Hopkins | 150/102 X |
| 781,056 | 1/1905 | Duncan . | |
| 1,382,446 | 6/1921 | Warren | 224/222 X |
| 1,561,352 | 11/1925 | Parkinson | 150/134 X |
| 1,972,480 | 9/1934 | Gomi . | |
| 3,199,754 | 8/1965 | Sorensen | 224/222 |
| 3,664,560 | 5/1972 | Perkins | 224/253 X |
| 3,670,933 | 6/1972 | Jones . | |
| 3,942,693 | 3/1976 | Tocci | 150/102 X |
| 4,209,048 | 6/1980 | Sandos | 150/432 |
| 4,332,338 | 1/1982 | Christiansen . | |
| 4,341,331 | 7/1982 | McDougall . | |
| 4,461,030 | 7/1984 | Knudsen . | |
| 4,570,688 | 2/1986 | Williams | 150/102 X |
| 4,572,415 | 2/1986 | Fehr | 224/253 |

FOREIGN PATENT DOCUMENTS

| | | | |
|---|---|---|---|
| 2419043 | 11/1979 | France | 224/252 |
| 191321 | 1/1923 | United Kingdom | 224/222 |

*Primary Examiner*—Henry J. Recla
*Assistant Examiner*—Robert Petrik
*Attorney, Agent, or Firm*—Baker, Maxham & Jester

[57] ABSTRACT

A wallet assembly for detachably securing to an individual's ankle or the like comprises a wallet formed such that pockets thereof are oriented in a common direction, and the wallet is foldable across the front to secure the pockets and is detachably securable in the folded position with an attachment assembly comprising a loop on the back of the wallet for detachably receiving a strap having quick release fastening member such as Velcro fasteners for detachably attaching the assembly to an ankle or the like.

10 Claims, 1 Drawing Sheet

SECURITY WALLET

This is a continuation of co-pending application Ser. No. 925,748, filed on Oct. 31, 1986, now abandoned.

BACKGROUND OF THE INVENTION

The present invention relates to wallets and the like and pertains particularly to a security wallet for detachable attachment to the ankle or the like.

Men typically carry their wallets in a rear or in a breast pocket. Such locations are well known to pickpockets. As a result, a wallet becomes an easy mark for a pickpocket, particularly in certain areas of the city.

One approach to the securement of money against loss or pickpockets is the use of a money belt. This, however, is inconvenient in that it requires the removal of the belt or opening of the clothing to provide access to the contents of the belt.

The carrying of a wallet is also inconvenient when wearing certain clothing, such as beach or sport clothing for certain types of sports. For this reason, it is desirable that certain means be available for the carrying of a wallet other than in a pocket of the individual.

It is also known that sitting on a wallet that is held in a person's rear pocket may cause problems to that person's lower back.

Numerous attempts at the designing of wallets to be carried, such as strapping to the arm or the like, are known. Examples of the prior art approach to this problem are illustrated for example in the following patents:

| Patent No. | Inventor |
|---|---|
| 781,056 | Duncan |
| 1,972,480 | Gomi |
| 3,670,933 | Jones |
| 4,332,338 | Christiansen |
| 4,341,331 | McDougall |
| 4,461,030 | Knudsen |

While many of these solve the basic problem in that it enables a person to strap the wallet or pouch to an ankle or arm so as to carry it without pockets or so as to secure it beneath a pants leg or the like for security purposes, they do have drawbacks. One major drawback of the prior art wallets is that they must be removed in order to have access to the contents thereof.

Another drawback is that the attachment means is permanently secured thereto, making it a part of the wallet package, and therefore inconvenient to carry in the conventional fashion.

It is, therefore, desirable to provide an improved wallet that has means for access thereto while in the secured position and can be carried in a conventional fashion.

SUMMARY AND OBJECTS OF THE INVENTION

It is the primary object of the present invention to provide an improved wallet assembly.

In accordance with the primary aspect of the present invention, a wallet includes an attachment assembly that is detachably connectable thereto for detachably connecting the wallet to an ankle or the like with optional orientation such that access can or cannot be had to the contents of the wallet while in the secured position.

BRIEF DESCRIPTION OF THE DRAWING

The above and other objects and advantages of the present invention become apparent from the following description when read on conjunction with the drawings wherein.

DETAILED DESCRIPTION OF A PREFERRED EMBODIMENT

Figure 1:
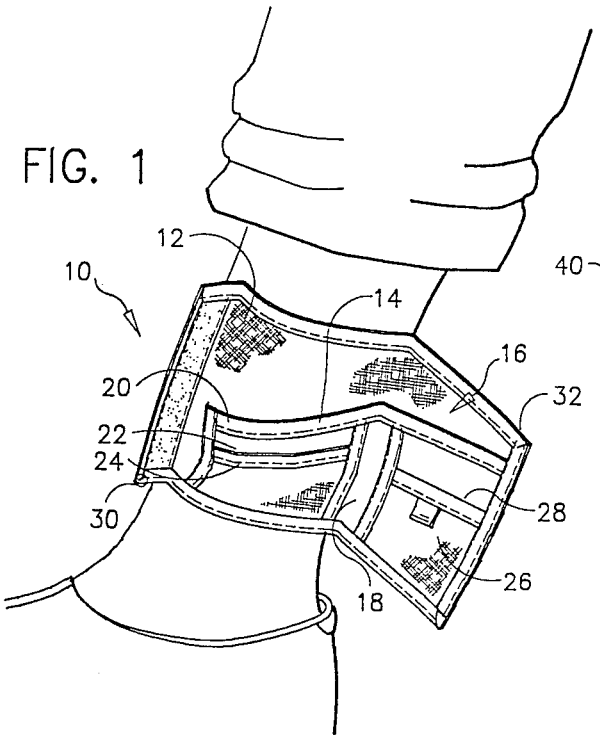
FIG. 1 is a perspective view showing a preferred embodiment of the invention secured in position.

Referring to FIG. 1 of the drawings, a money receptacle or wallet assembly, designated generally by the numeral 10, is illustrated in position around an ankle. This wallet assembly comprises a plurality of generally rectangular fabric panels of suitable pliable material, such as Nylon, leather or any other suitable material secured together along a periphery thereof to form a plurality of pockets. The illustrated embodiment comprises a back panel 12 secured along a longitudinal lower edge and at least one transverse edge to a front panel 14 for forming a bill pocket 16. The pocket 16 thus opens along a longitudinal upper edge so that it can be oriented to open vertically. The arrangement is such that the wallet folds, for example, along a center line 18 toward the front of the wallet.

The front of the wallet contains from one to a plurality of pockets, such as pocket 22 for receiving credit cards, pictures or the like. Other suitable pockets may also be included, such as for example a change pocket 26 for receiving and containing change and the like. This pocket also opens upwardly and secured closed, such as by a suitable flap (not shown) or by hook and loop fastening means (not shown) with a pull tab 28 for opening this pocket may also be provided. The wallet includes, in the preferred form, a strip 30 of hook and loop fastening means for engaging and securing to a back strip 32 of a complementary hook or loop fastening means at the opposite end of the wallet on the back side thereof. This is preferably a type of fastening system with hook and loops, such as available under the trademark Velcro. Thus, the wallet can be releasably secured in a closed position.

Figure 2:
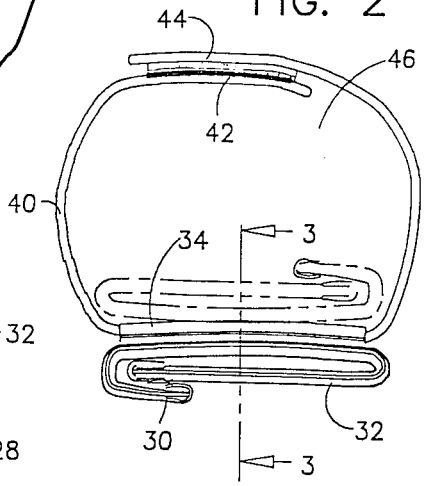
FIG. 2 is a top view of the wallet assembly shown closed and in position as secured.
Figure 3:
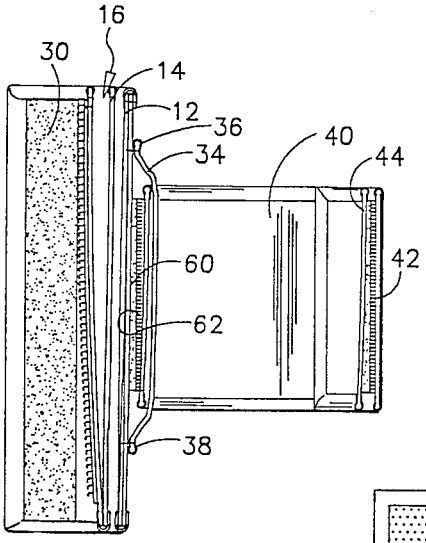
FIG. 3 is an elevation view in section on lines 3—3 of FIG. 2.

Referring to FIGS. 2 and 3, the attachment means of the wallet are illustrated and comprise a loop 34, which may be integral with or secured to the back of the back panel 12, such as along upper edges 36 and lower edges 38. This provides a loop for the receipt of a strap 40, which has a suitable width to comfortably support the wallet and a length to suitably encircle a leg of an individual and secure the wallet in place on the leg.

The loop 34 is on one of the sides of the back panel to one side of the center fold line thereof, such that the wallet can be folded and closed in the closed position, as in FIG. 2. The loop is preferably on the order of about the width of the wallet (FIG. 3) and has a length of about the same or slightly less for stability of the connection. The strap 40 is preferably of a width to snugly fit the loop. The strap 40 has suitable quick release securing means at the ends thereof as illustrated in FIGS. 1 and 2. The fastening means comprises hook means 42 at one end and loop means 44 at the opposite end thereof for overlapping and securing in place, such as around the ankle, leg or the like. The binding strap also has Velcro in the middle to stabilize the connection to the wallet.

Referring to FIG. 3, there is illustrated a top view of the wallet secured in position as through around an ankle with the wallet shown in the closed position.

The wallet can take any suitable form, such that the front side of the wallet is arranged such that the pockets all open in a single direction to one side, such as up as shown in FIG. 1. This enables the wallet to be arranged as shown, such that the wallet can be opened while in the secured position around an ankle. This arrangement enables a person to secure the wallet around the ankle and beneath the trouser legs for security purpose. The person can then readily access the wallet and the contents thereof without removing it from the ankle. The person can optionally make the wallet contents less accessible by rotating the binding strap one-hundred eighty degrees around its long axis and reinserting it in the loop so the wallet is held inside the strap.

The illustrated construction and arrangement also enables complete removal of the attaching strap 40 and the use of the wallet in the conventional fashion by inserting it into the trousers pocket or a coat pocket in a conventional fashion. Hook and loop fastening means 60, 62, as shown in FIG. 3, may also be secured to the middle of strap 40 and behind loop 34 to secure the strap more firmly to the wallet and stabilize it.

Figure 4:
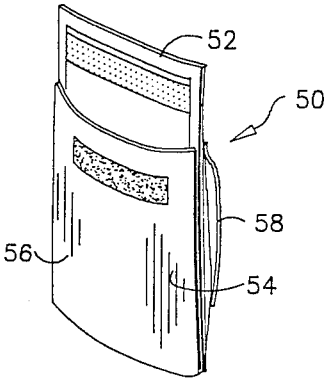
FIG. 4 is a front perspective view of an alternate embodiment of the invention.
Figure 5:
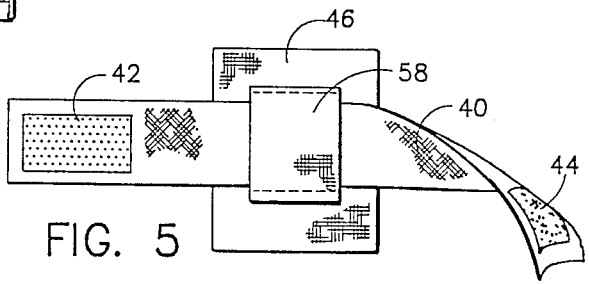
FIG. 5 is a rear view of the embodiment of FIG. 4.

An alternate embodiment is illustrated in FIGS. 4 and 5 wherein a detachable pouch 50 is constructed of a suitable fabric, such as leather, Nylon or other suitable means with front and back panels forming a pocket and a closure flap 52. The pouch is constructed of a sufficient size to receive a wallet folded in the conventional fashion. The pouch includes a front panel 54 and a rear panel 56 formed together or secured together to form the pouch. The flap or cover 52 is preferably secured in the closed position by suitable fastening means, such as hook and loop fastener.

The pouch is provided with a loop 58 on the back thereof for receiving the attaching strap 40 as in the previous embodiment. This construction and arrangement enables access to the contents thereof without removing the receptacle from its position around the ankle or the like.

In operation of the preferred embodiment, the wallet preferably comes from the supplier with an attachment strap and a loop as illustrated. The purchaser can then selectively carry the wallet in the conventional fashion simply by removing the attachment strap 40 and carrying the wallet in the conventional fashion in this trouser pocket or coat pocket. In order to attach the wallet in accordance with the invention, the attachment strap is selected and inserted through the loop 34. The wallet is then oriented such that the pockets open in the outward and upward fashion and in the preferred form is secured closed. The wallet and strap is then attached around the ankle of the individual, preferably beneath the trouser leg or in any other manner.

It is also apparent that the wallet can be attached around an arm, such as a wrist, upper arm or the like. It can be arranged so that the contents can be readily accessible without removal of the receptacle from its secured position, or optionally inside the strap for non-accessibility.

The alternate embodiment of the pouch is utilized in a similar fashion by attachment of the pouch and strap to an ankle, arm or the like. The wallet is then inserted and carried in the pouch in a suitable fashion. The pouch can also be used for other items as desired.

While I have illustrated and described my invention by means of specific embodiments, it is to be understood that numerous changes and modifications may be made therein without departing from the spirit and scope of the invention as defined in the appended claims.

I claim:

1. A security wallet assembly comprising, in combination, a wallet including a substantially rectangular back panel of pliable material having top and bottom edges and opposite end edges, a front panel of pliable material secured to one side of said back panel to define an upwardly opening pocket therebetween for accommodating currency and the like, said front and back panels foldable together along a vertically extending center line centrally of said end edges into and out of an aligned overlapping relationship for positioning said wallet in either a closed or open condition respectively;

means including a flap on one edge of said back panel for releasably retaining said wallet in said closed condition;

a strap of pliable material having opposite ends;

means for releasably securing said strap opposite ends together;

a substantially rectangular panel of pliable material having top and bottom edges secured to said back panel on the side opposite the front panel forming the upper opening pocket along said top and bottom edges on the side of said center line adjacent said flap, said rectangular panel defining with said back panel a loop for slideably receiving said strap with said strap extending transversely to said center line to enable said strap to be secured to an appendage of a person, with said wallet supported on said strap and with said wallet pocket readily accessible to said wearer without removal of the wallet from the appendage; and means within said loop and on said strap for releasably retaining said wallet from sliding movement on said strap.

2. A wallet assembly according to claim 1 wherein:

said means for releasably retaining said wallet in said closed position comprises hook and loop fastening means along the ends of said wallet and on said flap.

3. A wallet assembly according to claim 1 wherein:

said means for releasably securing said strap opposite ends together comprises hook and loop fastening means.

4. A wallet assembly according to claim 1 wherein:

said means within said loop and on said strap for releasably retaining said wallet from sliding movement on said strap comprises hook and loop fastening means on said strap and on said back panel.

5. A security wallet assembly comprising, in combination, a wallet including a substantially rectangular back panel of pliable material having top and bottom edges defining a height of said panel and having opposite end edges, a front panel of pliable material secured to one side of said back panel to define an upwardly opening pocket therebetween for accommodating currency and the like, said front and back panels foldable together along a vertically extending center line centrally of said end edges into and out of an aligned overlapping relationship for positioning said wallet in either a closed or open condition respectively;

means including a flap on one edge of said back panel for releasably retaining said wallet in said closed condition;

an elongated strap of pliable material having opposite ends and opposite side edges defining a width, said width exceeding one-half the height of said pack panel;

hook and loop fastening means for releasably securing said strap opposite ends together;

a substantially rectangular panel of pliable material having top and bottom edges secured to the back panel on the side opposite the front panel forming the upper opening pocket along said top and bottom edges on the side of said center line adjacent said flap, said rectangular panel defining with said back panel a loop for slideably receiving said strap with said strap extending transversely to said center line to permit said strap to be secured to an appendage of a person, with said wallet supported on said strap and with said wallet pocket readily accessible to said wearer without removal of the wallet from the appendage; and hook and loop fastening means in said loop and on said strap for releasably retaining said wallet from sliding movement on said strap.

6. A wallet assembly according to claim 5 wherein:

said means for releasably retaining said wallet in said closed position comprises hook and loop fastening means along the ends of said wallet and on said flap.

7. A security wallet assembly comprising, in combination, a wallet including a substantially rectangular back panel of pliable material having opposite end edges, a front panel of pliable material secured to one side of said back panel to define an upwardly opening pocket therebetween for accommodating currency and the like, said front and back panels foldable together along a vertically extending center line centrally of said end edges into and out of an aligned overlapping relationship for positioning said wallet in either a closed or open condition respectively;

means including a flap on one edge of said back panel for releasably retaining said wallet in said closed condition;

a strap of pliable material having opposite ends;

means for releasably securing said strap opposite ends together;

a substantially rectangular panel of pliable material having top and bottom edges secured to the side opposite the panel forming the upper opening pocket along said top and bottom edges on the side of said center line adjacent said flap, said rectangular panel defining with said back panel a loop for slideably receiving said strap with said strap extending transversely to said center line to permit said strap to be secured to an appendage of a person with said wallet supported on said strap and with said wallet pocket readily accessible to said wearer without removal of the wallet from the appendage; and means on said opposite side of said back panel and said strap for releasably retaining said wallet from sliding movement on said strap.

8. A wallet assembly according to claim 7 wherein:

said means for releasably retaining said wallet in said closed position comprises hook and loop fastening means along the ends of said wallet and on said flap.

9. A wallet assembly according to claim 8 wherein:

said means for releasably securing said strap opposite ends together comprises hook and loop fastening means.

10. A wallet assembly according to claim 9 wherein:

said means on said opposite side of said back panel and said strap for releasably retaining said wallet from sliding movement on said strap comprises hook and loop fastening means on said strap and on said back panel.

* * * * *